US007500653B1

(12) United States Patent
Hartman et al.

(10) Patent No.: US 7,500,653 B1
(45) Date of Patent: Mar. 10, 2009

(54) T-POST EXTENSION

(76) Inventors: Galen Hartman, 4300 Cothrin Ranch Rd., Shingle Springs, CA (US) 95682; Kellie Hartman, 4300 Cothrin Ranch Rd., Shingle Springs, CA (US) 95682

( * ) Notice: Subject to any disclaimer, the term of this patent is extended or adjusted under 35 U.S.C. 154(b) by 243 days.

(21) Appl. No.: 11/135,839

(22) Filed: May 23, 2005

(51) Int. Cl.
*E04H 17/00* (2006.01)

(52) U.S. Cl. ..... 256/1; 256/22; 256/DIG. 5

(58) Field of Classification Search ..... 256/1, 256/10–19, 22, DIG. 5; 294/61
See application file for complete search history.

(56) References Cited

U.S. PATENT DOCUMENTS 2,509,113 A * 5/1950 Sweet ..... 294/61
2,854,101 A * 9/1958 Carper ..... 256/52
3,267,805 A * 8/1966 Ackerman ..... 359/538
4,070,007 A * 1/1978 Minor et al. ..... 256/19
4,193,583 A 3/1980 Witt
4,763,879 A * 8/1988 Wasicek et al. ..... 256/36
4,889,322 A * 12/1989 Wagner ..... 256/36
5,188,342 A 2/1993 Ouellette et al.
5,207,466 A * 5/1993 Ohlson ..... 294/61
5,356,101 A 10/1994 Malloy
5,395,093 A * 3/1995 Chrisman ..... 256/47
5,412,158 A * 5/1995 Yearwood ..... 174/163 F
5,440,834 A * 8/1995 Kleinert ..... 47/47
5,440,837 A * 8/1995 Piltingsrud ..... 49/139
5,460,344 A * 10/1995 Malloy ..... 248/156
5,518,333 A 5/1996 Cienkus, Jr. et al.
5,577,710 A 11/1996 Kirby
5,593,143 A * 1/1997 Ferrarin ..... 256/68

(Continued)

OTHER PUBLICATIONS

Lisa Schmidt and Jim Knight, "Electric Fencing to Control Deer and Elk on Montana's Farms and Ranches", Montana State University Extension Service, Dec. 2000.

(Continued)

*Primary Examiner*—Daniel P Stodola
*Assistant Examiner*—Nahid Amiri
(74) *Attorney, Agent, or Firm*—John P. O'Banion

(57) ABSTRACT

A T-post extension is disclosed for extending the effective length of an existing T-post to increase the height of a fence. The T-post extension has a plurality of engagement members that slidably engage a top portion of a T-post at opposing surfaces of the T-post to provide steadfast coupling of the T-post extension with the existing T-post. The T-post extension includes a body section generally matching the cross section of the T-post and a plurality of tines extending outward from an end of the body section. The tines are configured to slide over and engage an end of the T-post to extend the length of the T-post. The tines may be configured to engage one or more internal corners of the T-post so that existing wire running at the top of the T-post is uninterrupted.

20 Claims, 7 Drawing Sheets

U.S. PATENT DOCUMENTS

| | | | | |
|---|---|---|---|---|
| 5,731,895 | A * | 3/1998 | Owczarzak et al. | 359/515 |
| 6,039,307 | A * | 3/2000 | De Zen | 256/19 |
| 6,330,998 | B1 | 12/2001 | Roy | |
| 6,443,433 | B1 | 9/2002 | Auldridge | |
| 6,543,750 | B1 * | 4/2003 | Calzone | 256/1 |
| 6,612,551 | B1 * | 9/2003 | Roy | 256/1 |
| 6,705,598 | B2 | 3/2004 | Collins | |
| 7,028,991 | B2 * | 4/2006 | Egan | 256/1 |
| 7,108,249 | B2 * | 9/2006 | Bechtel | 256/65.14 |
| 7,216,852 | B2 * | 5/2007 | Gravelle | 256/10 |

OTHER PUBLICATIONS

Kencove Farm Fence Supplies, "T-Posts-Galvanized" sales web page, located at <http://www.kencove.com/ShopItemIG.php?item=T+Posts+-+Galvanized>, printed Dec. 2004.

Hutchison, Inc., "Fence Accessories" sales web page, located at <http://www.hutchison-inc.com/html/fence_wire/fence/accessories.php>, printed Dec. 2004.

* cited by examiner

T-POST EXTENSION

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to T-post extensions, and more particularly to a T-post extension that is slidably received on en existing T-post to add extra height to a fence.

2. Description of Related Art

T-posts are widely used for fencing along boundaries, particularly around large plots of land to keep in livestock or other animals and to keep out unwanted wild animals. The posts generally have a T-shaped cross section, which gives them their name, and are typically made of hot-rolled steel.

Typically, an end of each T-post is driven into the ground to form a succession of the posts along a line with a typical post-to-post spacing. Several strands of wire, either barbed or plain, are then stretched generally parallel to the ground along the series of posts and fastened individually to the posts with each strand being spaced one above the next.

Although current T-posts may be found in many lengths, many existing fences were typically built with five-foot length posts, which result in a fence which is four feet high after being driven into the ground. That height has been found to be sufficient to restrain some domesticated livestock such as cattle. However, four foot high fences have been found to be insufficient for restraining some breeds of horses as well as keeping out many varieties of wild animals such as deer, elk etc.

Thus, there is a need for higher fencing up to a level of six, eight, ten or more feet. Typical options available to the landowner include removing what may be an otherwise useful fence and replacing it with a new, higher fence, or raising the height or the existing fence. Although the latter may appear more cost effective, complications of the current processes and tools available for extending fences often drive costs of repair beyond that of building a new fence. In addition, current modifications available for lengthening the height of fences, such as the coupling disclosed in U.S. Pat. No. 5,395,093, cause a loss in the continuity of the fence, which is not only esthetically disadvantageous, but may often result in a significantly weaker or unsound fence. In addition, a wire may be strung at or near the top of the post, leaving insufficient engagement length for the coupling, or requiring the top wire to be re-strung at a lower position on the fence.

Accordingly, it is an object of the present invention to provide a new and improved T-post extension for readily extending T-posts on existing fences.

Another object of the present invention is to provide a new and improved T-post extension that can easily be installed onto an existing fence with little or no modification to the fence. At least some of these objectives will be met in the invention described hereinafter.

BRIEF SUMMARY OF THE INVENTION

The present invention generally pertains to a T-post extension for extending the effective length of an existing T-post to increase the height of a fence. The T-post extension has a plurality of tines that slidably engage a top portion of a T-post at opposing surfaces of the T-post to provide steadfast coupling of the T-post extension with the existing T-post.

An aspect of the invention is an apparatus for extending the length of a T-post having generally a T-shaped cross section. The apparatus includes a body section and a plurality of engagement members extending outward from an end of the body section. The engagement members are configured to slide over and engage an end of the T-post to extend the length of the T-post.

In one mode of the current aspect, the plurality of engagement members are configured to engage one or more internal corners of the T-post.

Generally, the body section has an engagement axis and a substantially T-shaped cross section along its length generally perpendicular to the engagement axis, wherein the plurality of engagement members extend parallel to the engagement axis. The T-shaped body section may extend to a variety of lengths, but generally from at least 6 inches to four feet, and preferably between two and three feet.

Generally, the plurality of engagement members comprise two to four tines, preferably three to four tines, and more preferably four tines.

In a variation of the current embodiment, the engagement members may have an array of protrusions extending from the cylindrical surface. For example, the tines may comprise a section of rebar having protrusions running diagonally across the outer surface. The protrusions may also run radially or longitudinally across the outer surface. Alternatively, the engagement members may have a roughened external surface.

Generally, the plurality of engagement members comprise two to four tines, and preferably three two four tines, more preferably four tines.

In another mode of the present aspect, the engagement members are welded to the body section. Alternatively, the plurality of engagement members and body section are integral.

Generally, the T-post further comprises fencing wire running laterally along a top end of the T-post. In a preferred mode, the plurality of engagement members are configured to engage the top end of the T-post without interrupting the fencing wire.

In another mode of the present aspect the body section may comprise a body cap with channel configured to slidably receive a T-post extension along an engagement axis, wherein the engagement axis is generally parallel to the engagement members.

In a preferred embodiment of the present mode, the body cap further includes one or more set screws to tighten the body cap against the T-post extension. Alternatively, the body cap may have one or more tabs, wherein the tabs may be pressed against the T-post extension to lock the body cap from moving with respect to the T-post extension.

In another aspect of the present invention, an apparatus for extending the length of a T-post comprises a body section having a generally T-shaped cross-section, and means for engaging a top portion of the T-post. The engagement means is configured to be slidably received over the top portion of the T-post. Preferably, the engagement means is configured to engage one or more internal corners of the T-post.

Where the T-post has fencing wire running laterally along a top end of the T-post, the engagement means may be configured to engage the top end of the T-post without interrupting the fencing wire. Preferably, the engagement means is configured to leave at least a portion of the perimeter of the T-post exposed. The body section may also have an engagement axis generally perpendicular to T-shaped cross section such that the engagement means is configured to slidably engage parallel to the engagement axis.

Yet another aspect of the present invention is a coupling for extending an existing T-post, comprising a body cap having a channel configured to receive a T-shaped extension, and a plurality of engagement members coupled to the body cap. The engagement members are configured to slidably engage a top portion of the T-post to extend the effective length of the T-post. The coupling may further include a means for securing the body cap to the T-shaped extension.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 7B. It will be appreciated that the apparatus may vary as to configuration and as to details of the parts, and that the method may vary as to the specific steps and sequence, without departing from the basic concepts as disclosed herein.

Figure 1:
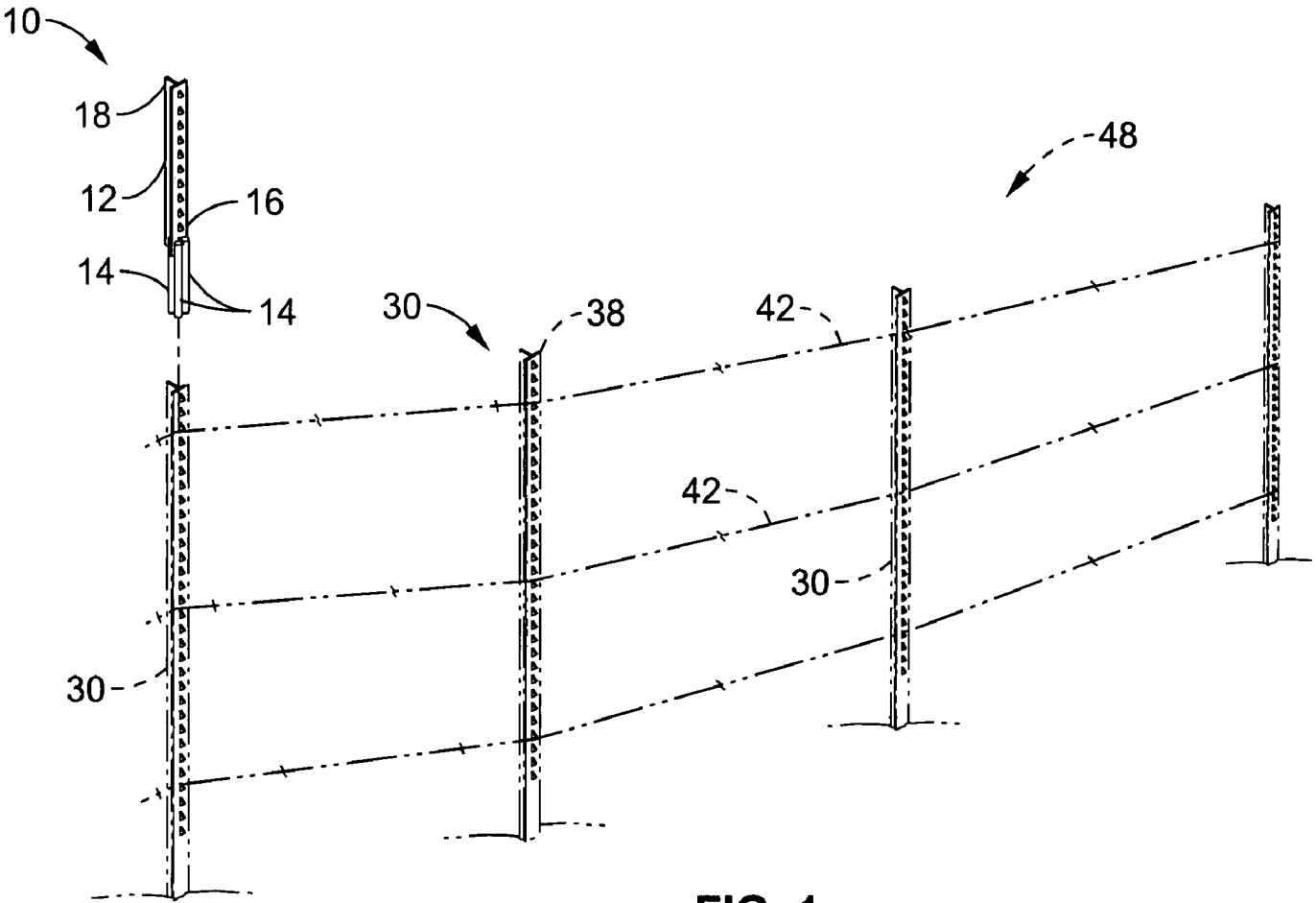
FIG. 1 is a view of a T-post extension of the present invention being installed on an existing T-post fence.
Figure 2:
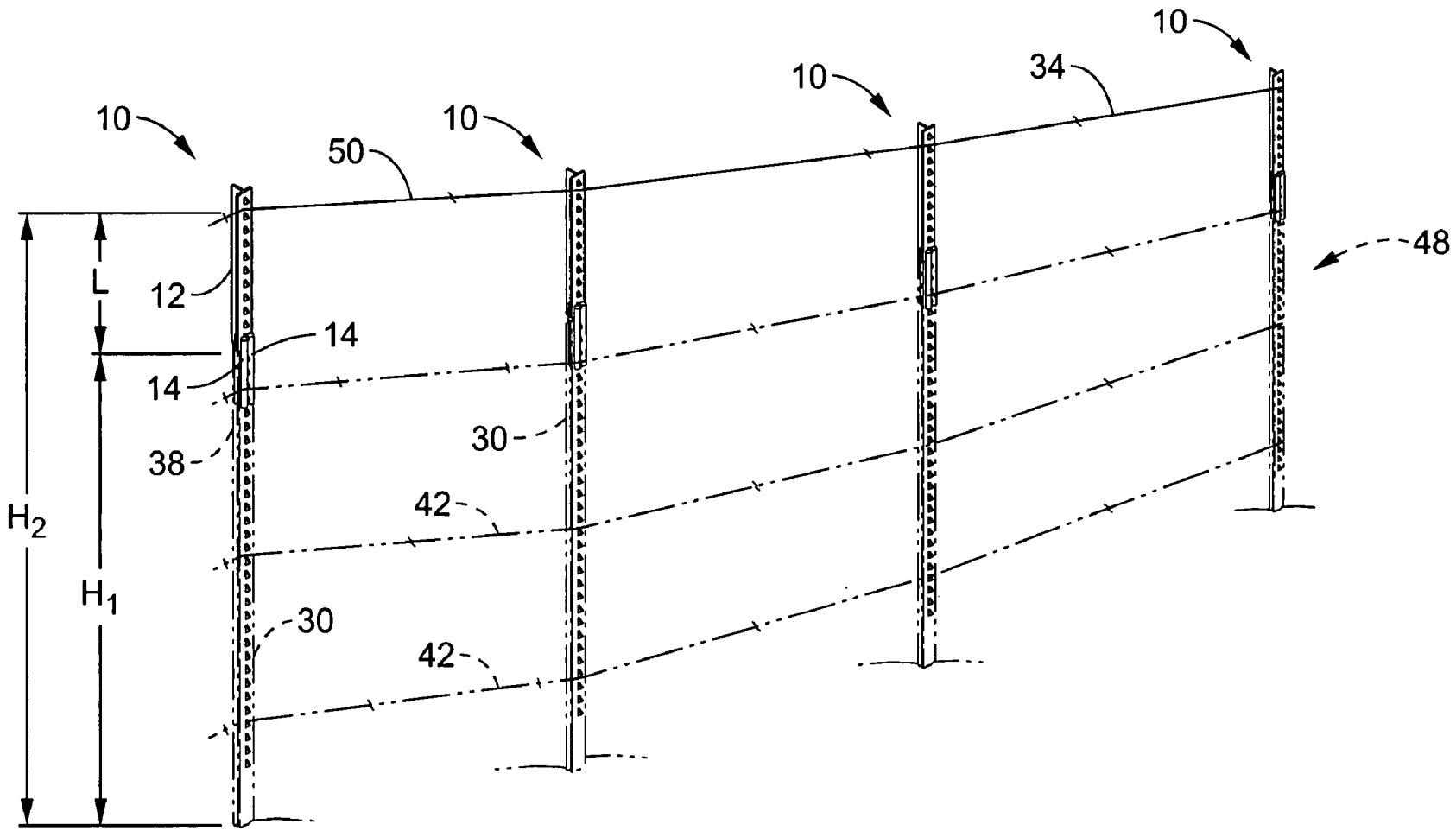
FIG. 2 illustrates a plurality of T-post extensions being used to lengthen the fence of FIG. 1 with additional wire.

Referring now FIGS. 1 and 2, T-post extension 10 may be used to lengthen an existing fence 48 having posts 30 and horizontal wiring 42. FIG. 1 is illustrative of an existing fence having three parallel barbed wire strands 42, with an original height $H_1$ of approximately 4 feet. T-post extension 10 may be slidably engaged over exposed or top end 38 of the post 30. The T-post extension 10 has an engagement means comprising a plurality of engagement members 14, or tines that extend outward lengthwise from the of T-shaped body section 12. The tines 14 are spaced apart to engage the top end 38 of the existing T-post 30.

As illustrated in FIG. 2, a plurality of T-post extensions 10 may be installed on each existing T-post of fence 48 to heighten the fence from original height $H_1$ to extended height $H_2$. The T-post extension 10 may be sized to various body section lengths L to achieve desired extended height $H_2$. For example, to achieve an extended length of 6 feet for a fence having an original height of 4 feet, a two foot T-post extension may be used. Hence, exemplary T-post extensions may have lengths varying from one, two, three feet or more. Additionally, the T-post extensions may be stacked two-up to further increase the extended height.

Figure 3:
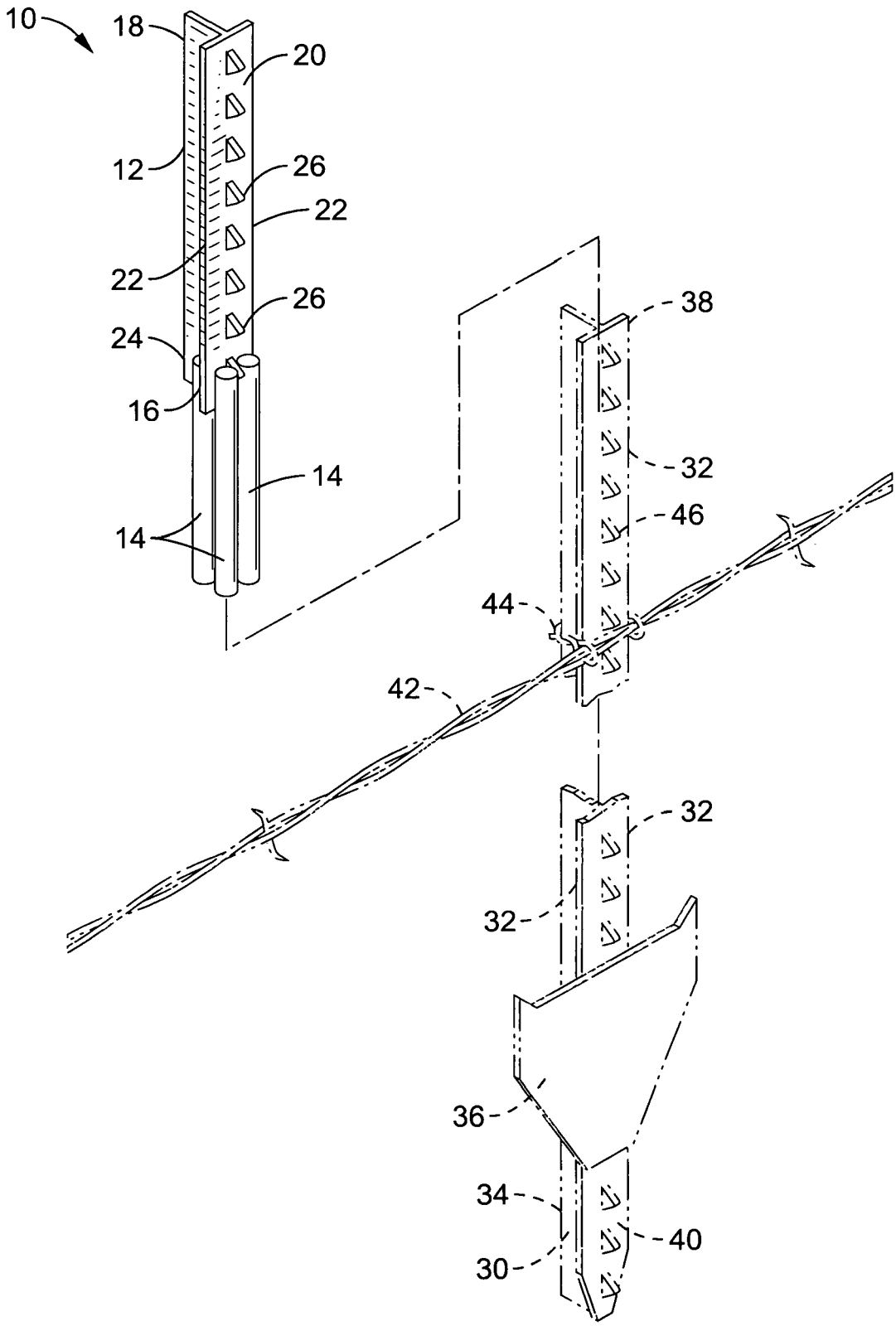
FIG. 3 illustrates the mounting interface of an exemplary T-post of the present invention with an existing T-post.

Referring now to FIG. 3, an exemplary T-post extension 10 of the present invention is illustrated in line with an existing T-post 30. The body section 12 is preferably configured with opposing arms 22 extending outward from leg 24, which are similar to arms 32 and leg 34 of post 30. The T-post may be fitted at its bottom end with a spade 36, which serves to resist against rotation of the post after it is driven into the ground. The T-post 30 may also have a series of studs 46 oriented on rear surface 40 along the length of the post. The studs 46 serve to lock the wire in place at a predetermined height and guard against displacement of the wire when it may be pressured toward movement either higher or lower. Wire cleats 44, or other fastening means, are used to fasten the wires 42 in place as they cross the post along the rear surface 40 to the T-post 30, such that the wires 42 rest between adjacent studs 46.

To install the T-post extension 10 on to the existing T-post, the bottom end of body member 12 is advanced in the direction of engagement axis 25 toward the top end 38 of the post so that the plurality of tines 14 slide over and engage opposing surfaces arms 32 and leg 34 of post 30. The tines 14 are generally parallel to the engagement axis 25 such that they continually engage the outer surface of post 30 along the length of the tines. As illustrated in FIG. 3, the upper end 38 of the post 30 may have wire 42 running laterally along the back surface 40, and cleat or other attachment means 44 holding the wire 42 in place. The tines 14 of the T-post extension 10 are configured to engage the upper end 38 either under or over the attachment means 44 holding the wire 42 without interrupting or removing either the wire 42 or attachment means.

Figure 4:
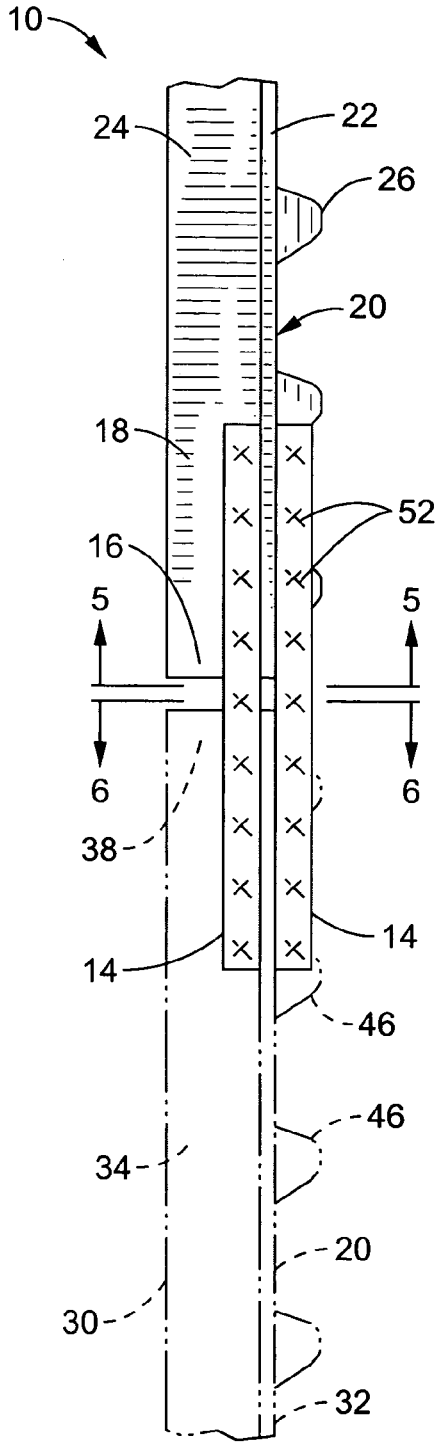
FIG. 4 is an expanded view of the T-post extension and existing post interface, with the T-post extension slightly offset from its final mounting position.

As further illustrated in FIG. 4, one or more tines 14 may be coupled to the bottom end of body 12 at the rear surface 20, which is formed by the two opposing arms 22. Preferably the tines coupled to the rear surface 20 pass along either side of studs 26. In addition, one or more tines 14 may be coupled to the upper surface of arms 22 and/or the sides of leg 24. To install the T-post extension 10, the tines 14 are slidably engaged along the surfaces of arms 32 and leg 34 of the post 30, until the bottom end 16 of the body section and the top end 38 of the post meet up.

To provide extra engagement resistance so that motion between the T-post extension 10 and the post 30 is restrained, the tines 14 may have protrusions 52 that extend from the outer surface of the tines. For example the tines may preferably comprise rebar, or similar material that has a roughened external surface. Protrusions 52 may run longitudinally are radially along the length of the tines, or diagonally as in the case of rebar. The tines 14 may also be oriented or oversized so that they form an interference fit with the surfaces of the post 30. With an interference fit, the tines will need to be deflected outward to engage the arms 32 and leg 34, thus generating a compressive force on the post to provide extra engagement resistance.

Figure 5A:
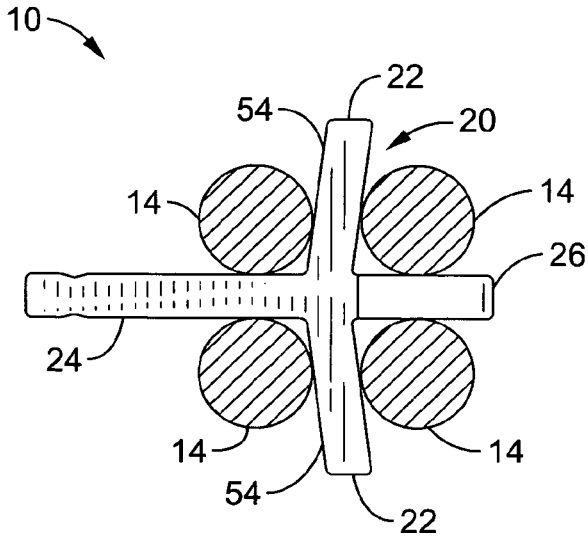
FIG. 5A is a cross-sectional view of an exemplary T-post extension of the present invention having four engagement members.
Figure 5B:
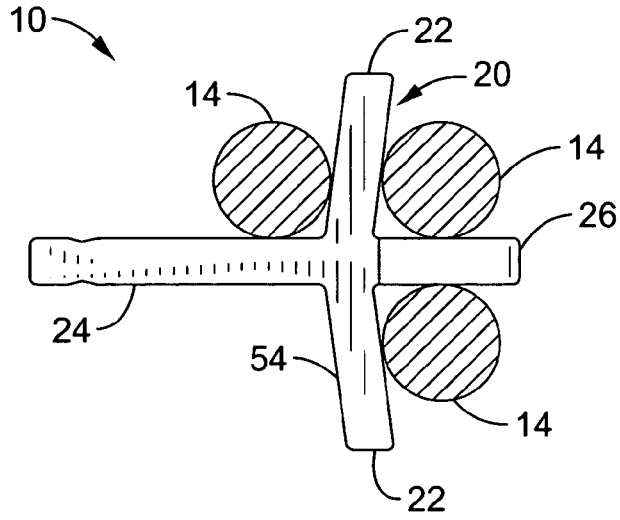
FIG. 5B is a cross-sectional view of an exemplary T-post extension of the present invention having three engagement members.
Figure 5C:
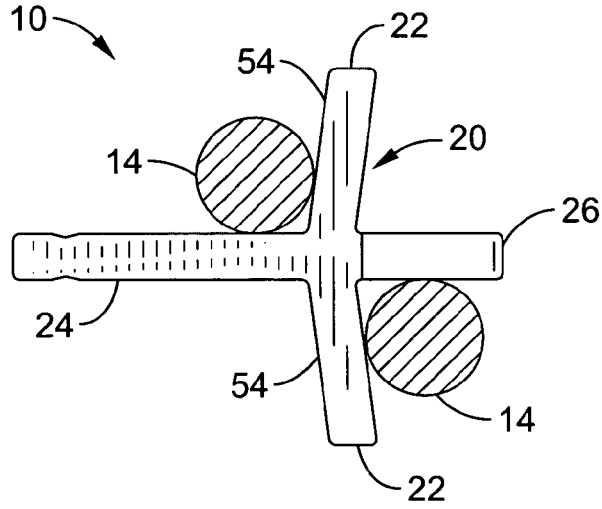
FIG. 5C is a cross-sectional view of an exemplary T-post extension of the present invention having two engagement members.
Figure 5D:
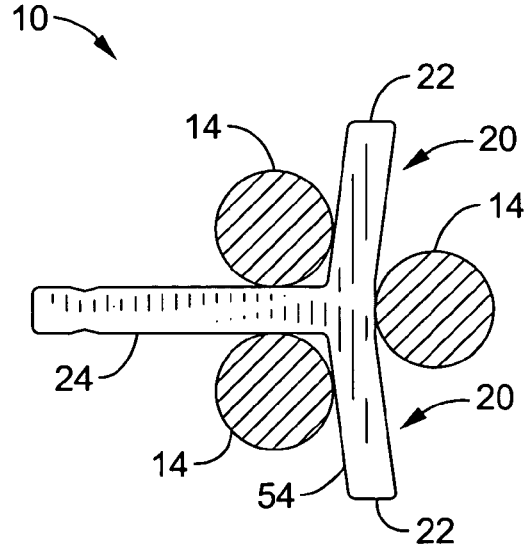
FIG. 5D is a cross-sectional view of an exemplary T-post extension of the present invention having three engagement members for use on a non-studded T-post.

Referring now to FIGS. 5A-5D, a plurality of different tines 14 may be installed on the body section 12 of the T-post extension. For example, four tines may be positioned at the upper and lower surfaces of the opposing arms 22, and adjacent to either side of leg 24 and studs 26, as illustrated in FIG. 5A. This configuration allows for most stable engagement between the post and the T-post extension 10. Alternatively, three tines 14 may be positioned on the body section 12, as illustrated in FIG. 5B. Another embodiment illustrated in FIG. 5C may comprise two opposing tines 14 aligned diagonally across the leg 34 on opposing rear surface 20 and front surface 54 of arms 22. For interfacing with a T-post 30 without studs as shown in FIG. 5D, one tine may be centered on rear surface 20, whereas two tines may be positioned on front surface 54 adjacent either side of leg 24.

Figure 5E:
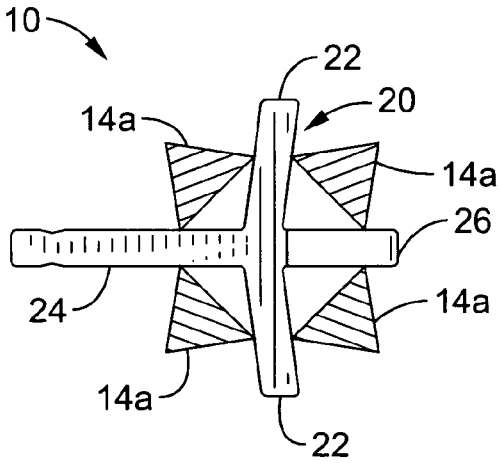
FIGS. 5E-5H illustrate cross-sectional views of T-post extensions having different shaped engagement members.
Figure 5F:
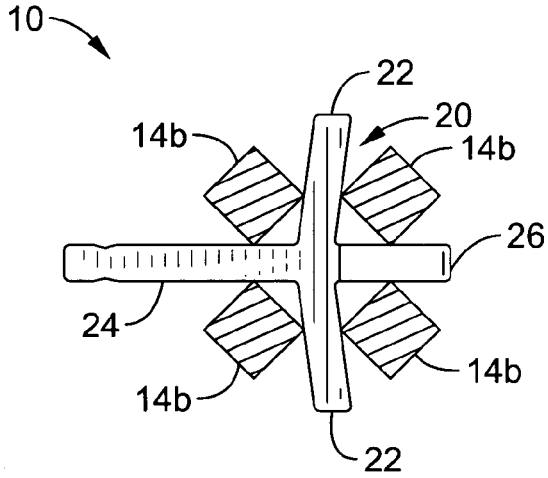
Figure 5G:
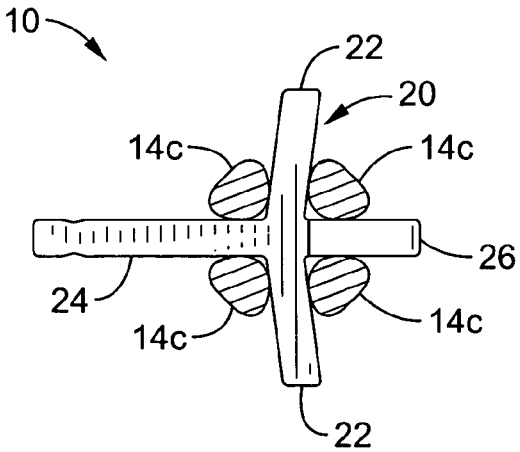
Figure 5H:
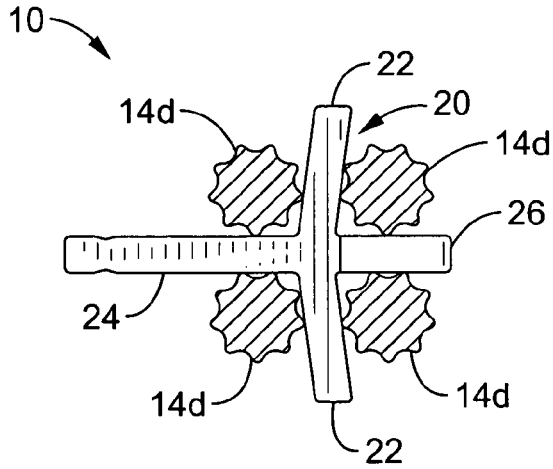

As illustrated in FIGS. 5E through 5H, the tines may comprise a number of alternative cross-sectional shapes. For example, tines 14*a* may comprise a triangular cross-section as shown in FIG. 5E, or tines 14*b* may comprise a rectangular cross-section as shown in FIG. 5F. Alternatively, tines 14*c* illustrated in FIG. 5G may be contoured to match the surfaces 20 and 54 and corresponding interface with leg 24 and studs 26. The configuration of FIG. 5G will have a larger contact surface with opposing surfaces 40 and 41 of the post 30 when engaged. Tines 14*d* may also have longitudinal undulations or ridges, as shown in FIG. 5H.

The tines illustrated in FIGS. 1-5H may be attached or integral with the body section 12. For example, the tines may be welded to the bottom end 16 of the body section 12. Alternatively, tines 14 may be integrally formed with the body section during fabrication such that the tines and body section are one continuous piece of material. The tines generally extend in the range of a couple of inches to 18 inches beyond the bottom end 16, and preferably in the range of 6 inches to 12 inches below the bottom edge 16. One skilled in the art would appreciate that the diameter or thickness of the tines may vary. Preferably, for a configuration utilizing rebar, the tines may comprise ⅜ to ⅝ inch steel rebar.

Figure 6:
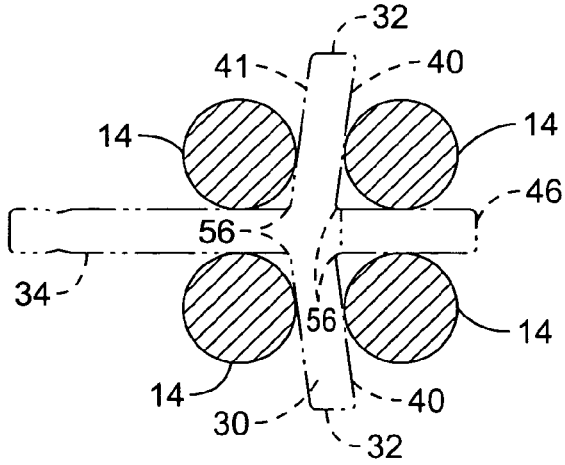
FIG. 6 is a cross-sectional view of interface between the engagement members of an exemplary T-post of the present invention with an existing T-post.

FIG. 6 illustrates the engagement of the tines 14 of a typical 4-tine T-post extension 10 with post 30. Because the tines 14 engage surfaces 40 and 41 at the internal corners 56, as opposed to the extremities of the post 30, the tines will engage the post consistently regardless of the size of the post 10 arm 32 to arm 32, or leg 34 to stud 46. Thus, the body section 12 may have smaller or larger cross-sectional dimensions than the corresponding post 30, but properly engage the post nonetheless. Thus, the body section 12 may comprise a one-size-fits-all configuration. Alternatively, the body section 12 may be configured to a number of different cross-sectional sizes to match a particular fence post esthetically.

To further match the post 30, the body section 12 may be coated to match the coloring of the post 30. For example, bottom end 16 may have a red or green coating, with the upper end 18 having a white coating.

Figure 7A:
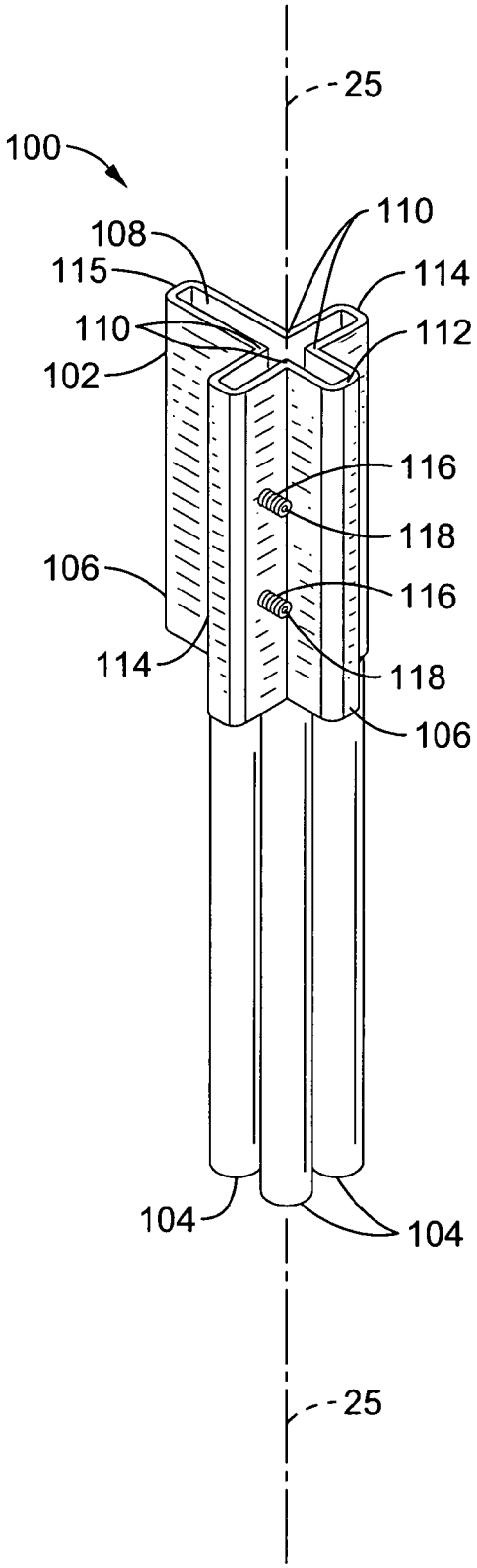
FIG. 7A illustrates an exemplary T-post coupling of the present invention.

FIG. 7A illustrates an alternative embodiment of a T-post coupling 100 having a body cap 102 and plurality of tines 104 for engaging a section of an installed T-post. Body cap 102 has a channel 108 that is shaped to receive an extender section 140 of T-post down the length of the body cap 102 toward the bottom end 106. The body cap 102 is shaped to have a leg section 115, opposing arm sections 114, and stud section 112, such that the extender section 140 can be slidably received by the body cap 102. To lock the T-post coupling 100 to the extender 140, coupling 100 may further comprise extendible means for securing the coupling 100 to the extender 140. The securing means may comprise a plurality of threaded holes 116 and set screws 118 may be placed at one or more of the internal corners 116, such that the screws are tightened onto the extender 140.

The body cap 102 may have a thicker cross-section at internal corners 110 to accommodate placement of the tines 104 at lower end 106. With tines placed at internal corners 110, they may be advanced over T-post 30 similarly to the embodiment shown in FIGS. 3 and 4.

Figure 7B:
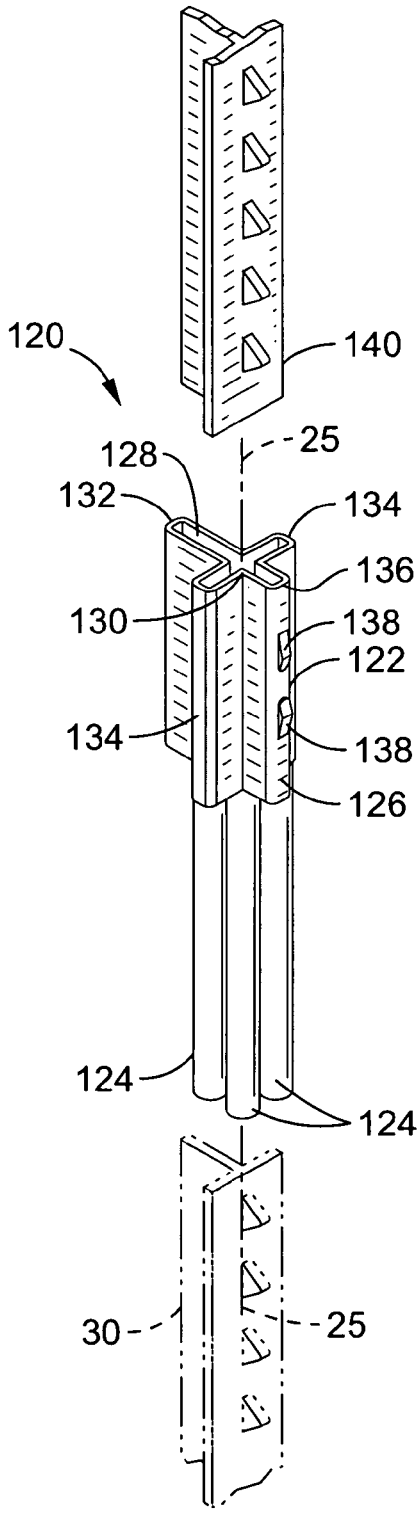
FIG. 7B illustrates an alternative T-post coupling of the present invention.

FIG. 7B illustrates an alternative T-post coupling 120 incorporating bendable tabs 128 to lock the coupling 120 to the extender 140. Bendable tabs 138 are preferably positioned on stud section 136 of body cap 122, such that inward deflection of the tabs locks the T-post coupling 120 from axial or vertical translation with respect to the extender 140.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for extending the length of a T-post used for fencing, the T-post having generally a T-shaped cross section defined by a leg and a pair of arms extending from the leg, the apparatus comprising:

a section of T-post fencing material having an elongated body section and generally a T-shaped transverse cross section defined by a leg and a pair of arms extending from the leg; and at least three elongated, separate, spaced-apart and generally longitudinally parallel engagement members, said engagement members having first ends joined to an end of the body section and having second ends extending outward from said end of the body section;

wherein the outward extending ends of the engagement members are configured to slide over an end of the T-post and provide rigid engagement by straddling and abutting at least a portion of the leg and arms of the T-post.

2. An apparatus as recited in claim 1, wherein the engagement members are configured to engage one or more internal corners of the T-post.

3. An apparatus as recited in claim 1:

wherein the body section has a length, an engagement axis and a substantially T-shaped cross section along its length generally perpendicular to the engagement axis; and wherein the engagement members extend parallel to the engagement axis.

4. An apparatus as recited in claim 3, wherein the tines have surface protrusions.

5. An apparatus as recited in claim 3, wherein the tines have a roughened external surface.

6. An apparatus as recited in claim 1, wherein the engagement members comprise cylindrical tines.

7. An apparatus as recited in claim 1, wherein the engagement members comprise four tines.

8. An apparatus as recited in claim 1, wherein the engagement members are welded to the body section.

9. An apparatus as recited in claim 1, wherein the engagement members and body section are integral.

10. An apparatus as recited in claim 1:

wherein the engagement members are configured to engage the top end of the T-post without interrupting fencing wire connected to the T-post.

11. An apparatus for extending the length of a T-post used for fencing, the T-post having generally a T-shaped cross section defined by a leg and a pair of arms extending from the leg, the apparatus comprising:

a T-post extension member formed as a section of T-post fencing material having an elongated body section and generally a T-shaped transverse cross section defined by a leg and a pair of arms extending from the leg; and three elongated, separate, spaced-apart and generally parallel engagement members, said engagement members having first ends joined to an end of the T-post extension member, said engagement members having second ends spaced-part and extending outward from said end of the T-post extension member;

wherein the outward extending ends of the engagement members are configured to slide over an end of the T-post and provide rigid engagement between the T-post and the T-post extension member by straddling and abutting at least a portion of the leg and arms of the T-post.

12. An apparatus as recited in claim 11, wherein said engagement members are configured to engage one or more internal corners of the T-post.

13. An apparatus as recited in claim 12:

wherein the engagement members are configured to engage the top end of the T-post without interrupting fencing wire connected to the T-post.

14. An apparatus as recited in claim 12, wherein the engagement members are configured to leave at least a portion of the perimeter of the T-post exposed.

15. An apparatus as recited in claim 11:

wherein the T-post extension member has an engagement axis generally perpendicular to the T-shaped cross section; and wherein the engagement members are configured to slidably engage parallel to the engagement axis.

16. An apparatus for extending the length of a T-post used for fencing, the T-post having generally a T-shaped cross section defined by a leg and a pair of arms extending from the leg, the apparatus comprising:

a T-post extension member formed as a section of T-post fencing material having an elongated body section and generally a T-shaped transverse cross section defined by a leg and a pair of arms extending from the leg; and four elongated, separate, spaced-apart and generally longitudinally parallel tines, said tines having first ends joined to an end of the extension member, said tines having second spaced-part ends extending outward from said end of the extension member;

wherein the outward extending ends of the tines are positioned in a square formation and configured to slide over and engage an end of the T-post; and wherein two of the tines straddle and abut said leg, and two of said tines straddle and abut each of said arms, thereby providing rigid engagement between said extension member and said T-post.

17. An apparatus as recited in claim 16, wherein the tines have generally a circular cross section and have surface protrusions.

18. An apparatus as recited in claim 16, wherein the tines have generally a circular cross section and have roughened external surfaces.

19. An apparatus as recited in claim 16, wherein the tines are welded to the extension member.

20. An apparatus as recited in claim 16, wherein the extension member and tines are integrally formed.

* * * * *